US008016485B2

(12) United States Patent
McCann

(10) Patent No.: US 8,016,485 B2
(45) Date of Patent: Sep. 13, 2011

(54) THEATER POPCORN CONTAINER FEATURING SIDE POCKETS, HANDLES, AND A RESEALABLE OPENING

(76) Inventor: James Brent McCann, Columbus, GA (US)

( * ) Notice: Subject to any disclaimer, the term of this patent is extended or adjusted under 35 U.S.C. 154(b) by 623 days.

(21) Appl. No.: 12/183,969

(22) Filed: Jul. 31, 2008

(65) Prior Publication Data

US 2010/0027917 A1 Feb. 4, 2010

(51) Int. Cl.

| | |
|---|---|
| ***B65D 33/10*** | (2006.01) |
| ***B65D 33/06*** | (2006.01) |
| ***B65D 30/22*** | (2006.01) |
| ***B65D 33/16*** | (2006.01) |
| ***B65D 30/20*** | (2006.01) |
| ***B65D 33/00*** | (2006.01) |

(52) U.S. Cl. ..... 383/10; 383/17; 383/38; 383/63; 383/120; 383/95

(58) Field of Classification Search ..... 383/10, 383/17, 20, 38, 120, 63, 95
See application file for complete search history.

(56) References Cited

U.S. PATENT DOCUMENTS

| | | | | |
|---|---|---|---|---|
| 560,469 | A * | 5/1896 | Butts et al. | 383/6 |
| 685,789 | A * | 11/1901 | McKendrick | 383/10 |
| 1,355,353 | A * | 10/1920 | Pease | 383/10 |
| 4,299,324 | A * | 11/1981 | Dickens | 206/170 |
| 4,904,488 | A | 2/1990 | LaBaw et al. | |
| 4,974,966 | A * | 12/1990 | Fabbi | 383/1 |
| 4,991,980 | A | 2/1991 | Cohen et al. | |
| 5,011,299 | A | 4/1991 | Black, Jr. et al. | |
| 5,458,556 | A * | 10/1995 | Hlubik | 493/231 |
| 5,540,333 | A * | 7/1996 | Gonzalez et al. | 206/541 |
| 5,630,544 | A | 5/1997 | Shane | |
| 6,030,652 | A | 2/2000 | Hanus | |
| 6,102,208 | A | 8/2000 | Huang | |
| 6,386,443 | B1 | 5/2002 | Szczerbinski | |
| 6,394,265 | B1 | 5/2002 | Tsao | |
| 6,644,540 | B2 | 11/2003 | Jamitzky et al. | |
| 6,655,526 | B2 | 12/2003 | Urman et al. | |

FOREIGN PATENT DOCUMENTS

FR 2699505 A1 * 6/1994

* cited by examiner

*Primary Examiner* — Jes F Pascua

(74) *Attorney, Agent, or Firm* — Smith Gambrell & Russell LLP

(57) ABSTRACT

A collapsible container for holding popcorn that is comprised of a front panel, a rear panel, and gusseted side panels. The front and rear panels have pockets mounted at the base of the container. The container also includes carrying handles incorporated into the top of the front and rear panels. The container also contains a releasably sealable opening that maybe sealed by a number of different methods and mechanisms. When the container is open, the user may add a topping, and then seal and shake the container in order to distribute the flavoring agent. Additionally, the user may seal the container, thereby trapping heat so as to maintain an elevated temperature for the popcorn. The resealable opening will also prevent accidental spillage of the popcorn. A fill line is located on the interior of the container in order to allow the user to know how much popcorn to put into the container such that it can still be easily closed.

12 Claims, 3 Drawing Sheets

THEATER POPCORN CONTAINER FEATURING SIDE POCKETS, HANDLES, AND A RESEALABLE OPENING

FIELD OF THE INVENTION

This invention generally relates to flexible containers for holding food products and in particular to a collapsible container for holding popcorn having dual attached collapsible pockets, carrying handles, and a resealable opening.

BACKGROUND OF THE INVENTION

One of the most traditional items associated with an evening at the cinema is a container of popcorn. Movie theaters make a substantial profit selling popcorn, candy, drinks, and other food items at their concession stands. However, if a patron orders a drink and a container of popcorn, both of their hand are full. Should the patron then wish to carry any additional items such as candy or napkins, it becomes a juggling act. This problem is compounded for a parent trying to carry concession items for themself as well as for a child or for multiple children. Accordingly, it would be desirable to provide an improved collapsible popcorn container which would provide convenient storage spaces for additional concession items as well. Furthermore, it would also be desirable for the popcorn container to have handles that would make not only make it easier to carry the container, but would also prevent spillage during transit from the concession stand to the patron's seat. Furthermore, the theater could use the additional space provided by the container's pockets as a location to place advertisements, coupons, or promotional brochures prior to selling popcorn to the customer. Furthermore, the pockets could also have a coupon directly printed on them which the patron could tear off after they were done eating the popcorn.

Generally, a mainstay of traditional popcorn containers is the inclusion of internally folded panels ("gussets"). The gussets fold inwardly, enabling the container to be folded flat for storage and shipment, and then unfolded when the food product is ready to be placed inside the container. These gusseted panels connect to front and rear panels which, in combination, define the structure of an expanded container when the gussets have unfolded.

Additionally, a mainstay associated with purchasing popcorn at a movie theater is the addition of a topping such as butter or a flavoring powder to the popcorn. However, when the patron adds the topping to the popcorn, it only flavors the top layer. As such, there is too much topping on the upper layer of the popcorn, whereas the lower layer is not coated with any of the flavoring agent. Accordingly, it would be desirable to provide an improved collapsible popcorn container which would first allow the patron to add a topping to the popcorn and then allow the user to seal the container and shake it in order to evenly distribute the flavoring agent. A fill line located on the interior portion of the rear panel that allows one to know how much popcorn to place inside the container such that it can still be easily closed.

An additional problem associated with popcorn containers at movie theaters is that the top opening is not sealable. As such, the popcorn constantly releases heat, thereby reducing its temperature to that of the surrounding atmosphere. The reduction in temperature has a detrimental effect on the taste and smell of the popcorn. Accordingly, it would be desirable to provide an improved collapsible popcorn container which would allow the patron to seal the container when they are not eating the popcorn in order to trap the heat of the popcorn in order to help maintain an elevated temperature of the popcorn. Furthermore, the ability to seal the container will allow the user to eliminate any of the popcorn from falling out of the container as it is being moved or should the container accidently be knocked over or dropped.

Consequently a need exists to provide an inexpensive and effective container featuring a easy means to carry itself as well as additional items. Various objects and advantages of this invention will become apparent to those skilled in the art from the following detailed description of the preferred embodiment, when read in light of the accompanying drawings.

SUMMARY OF THE INVENTION

In accordance with the present invention as applied to a popcorn container, means are provided for allowing the user to easily carry the container with one hand. Furthermore, the container has two side pockets that provide additional storage capabilities. The container also contains a sealing means to prevent heat from escaping the container when not in use and to further guard against spillage should the container be knocked over from its typical stable resting position on a flat surface. The invention thereby allows a food container to be used more effectively as a dispensing receptacle for the food. Moreover, preferred embodiments of the invention for the most part can be manufactured using existing container production machinery and technology.

While exemplary embodiments will be described below, the invention generally provides a collapsible, elongate container for holding popcorn comprising a flat rectangular, bottom, a front panel and rear panel which are connected to inwardly folded, gusseted side panels, all of which are joined to a flat bottom. The front and rear panels each have an attached pocket. The pockets are comprised of a flat pocket bottom that is joined to the container, a pocket front panel spaced apart from the container, and a pair of inwardly folded, gusseted side panels extending upwards from the pocket bottom and joining the front pocket panel and the container to form a pocket opening. The container contains a lipped opening formed by folding the top of the front panel and rear panel outwards and then down towards the container's bottom until they are even with the top of the side panels. The lipped opening has a centrally placed hole sized for fitting the fingers of a human hand, such that it is able to be used as a handle while the container is being carried. A means for releasably sealing the container's lipped opening is provided in order to secure popcorn within the container.

DETAILED DESCRIPTION OF THE PREFERRED EMBODIMENT

Figure 1:
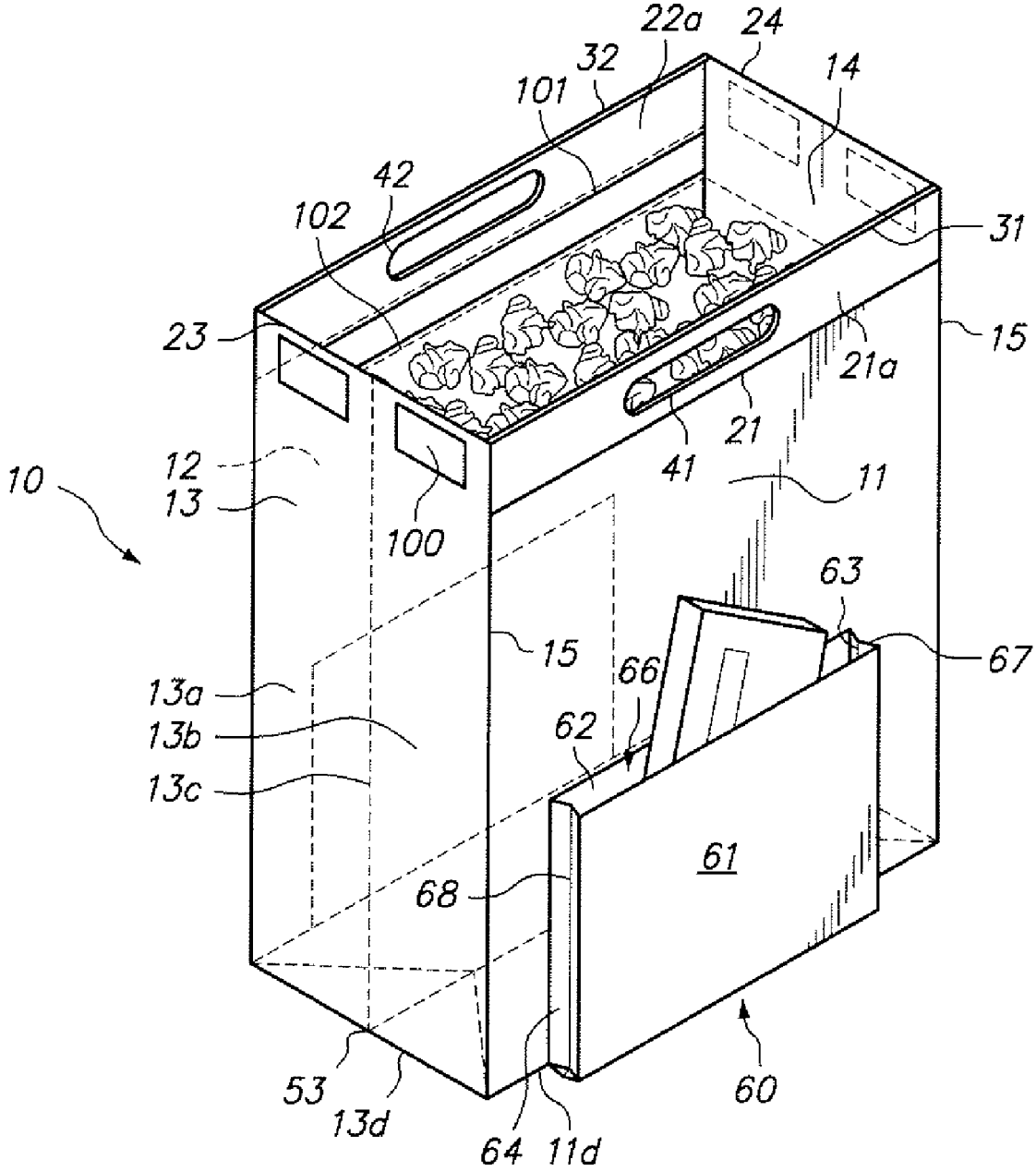
FIG. 1 is a front view in perspective illustrating the container with the front collapsible side pocket and handles.

Referring now to the drawings, the novel popcorn container of this invention can be better understood by reference to FIG. 1. Illustrated in FIG. 1 a popcorn container indicated generally at 10. The container has a front panel 11, a rear panel 12, a flat, rectangular bottom (50 in FIG. 3) and gusset side panels 13 and 14.

Figure 2:
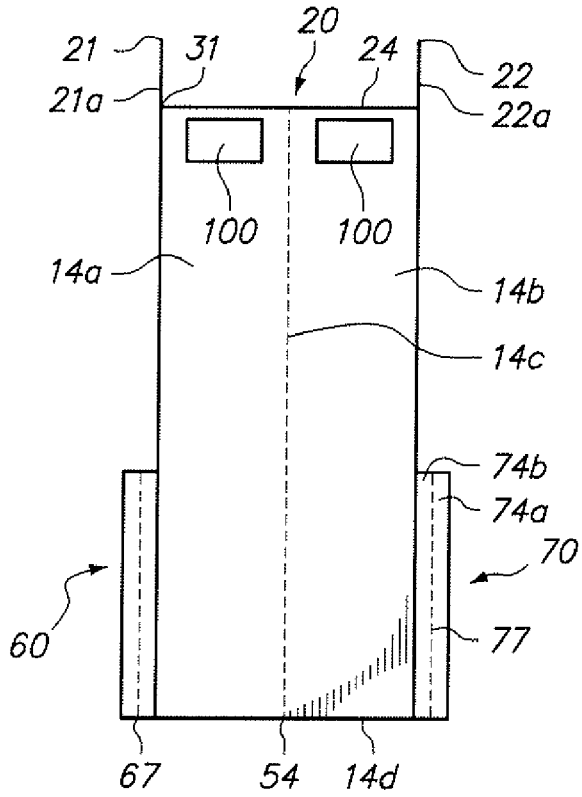
FIG. 2 is a side view of the container illustrating both side pockets and the front and rear panels before they are folded down to create the handles illustrated in FIG. 1.

Generally rectangular front and rear panels 11 and 12 are taller and wider than gusset side panels 13 and 14. The gusset side is shown in FIG. 2. As an example, gusset side panels 13 and 14 may each comprise a set of first and second gusset panels 13*a*, 13*b*, and 14*a*, 14*b* respectively, wherein each set of panels can be folded inwardly along fold lines 13*c* and 14*c*, respectively. The fold lines 13*c* and 14*c*, extend from the top of the gusset sides 23 and 24 to the bottom of the sides 53 and 54 respectively. These gusset panels may thereby create accordion type pleats on each side of the container, between the front and rear face panels 11 and 12, when the container is folded and collapsed.

Front and rear panels 11 and 12 are joined along the four corner edges 15 to gusset side panels 13 and 14 such that the base of each panel is parallel to one other.

The bottom of front panel 11*d* and rear panel 12*d* and the bottom of the sides 13*d* and 14*d* are joined to the bottom of the container 50. The front and rear panels 11 and 12 and the sides 13 and 14 extend upwardly towards the top opening 20.

The tops of the front 21 and rear panel 22 extend past the tops of the sides 23 and 24. The top portions of the front panel 21 and the top portion of rear panel 22 are folded outwardly and downwardly until the uppermost portion of front panel 31 and rear panel 32 are even with the upper most portion of side panels 23 and 24. This creates a lipped opening composed of front lip 21*a* and rear lip 22*a*.

The lipped opening contains front handle 41 and rear handle 42 that are formed by creating centrally placed holes, through front lip 21*a* and rear lip 22*a* respectively. The front handle 41 is composed of holes 41*a* and 41*b*. Rear handle 42 is composed of holes 42*a* and 42*b*. The holes are sized for fitting the fingers of an adult human hand. Although the two layers of material used to create the handles provide sufficient fortitude for a fully filled container to be carried without fear of tearing, a reinforcement backing can be added to provide additional strength. Furthermore, interlocking, plastic backings can be applied to the handles to provide additional support as well as a means for releasably sealing the container.

Adhesive patches 100 can be used as a means for releasably sealing the lipped opening can be located on the uppermost portions of the gusset side panels 13*a*, 13*b*, 14*a*, and 14*b*. When the user wishes to seal the container, he or she need could collapse the top of the container by bring handles 41 and 42 into contact and then squeeze each adhesive patch 100 against the opposite placement of adhesive on its respective side panel. An alternative means for releasably sealing the container could be an adhesive strip 101 located along the length of the interior of front lip 21*a* and rear lip 22*a* and beneath handles 41 and 42, respectively. A further sealing means could be a mating male rib or bead and a female sealing channel closure along the length of the container opening located in the same placement as strip 101. When the male and female portions are properly aligned and pressed together along the length of the container opening it would create an airtight closure.

A fill line 102 can be located on the interior portion of the container below the lipped opening which would indicate the highest level that the container should be filled so that it may still be closed by one the means for sealing the container.

Dual pockets, shown generally at 60 and 70 are provided. Each pocket has a rectangular front panel shown at 61 and 71 respectively. Each pocket also has generally rectangular side panels, shown on the front pocket 63 and 64, and the rear pocket 73 and 74. Each pocket also has a flat, rectangular bottom (65 and 75 in FIG. 3), a rectangular rear panel 62 and 72, and a top opening 66 and 76. The rear panel 62 is attached to the front panel 11 of the container 10. Similarly the rear panel 72 is attached to the rear panel 12 of the container 10.

Alternately, a separate pocket rear panel may not be used. For example, the pocket sides 63 and 64 may be secured to the container 10 so that the front panel 11 of the container forms the pocket rear panel 62. Similarly, sides 73 and 74 may be secured to the container 10 so that the rear panel 12 of the container forms the pocket rear panel 72. While the pockets can be placed anywhere on the front or rear panel of the container 10, it is desirable that they be positioned low enough to keep the container's center of gravity low to keep the container standing upright. The pockets can be positioned so that when unfolded, the flat pocket bottoms and the bottom of the container form a plane to provide maximum stability in keeping the container in an upright position.

The front pocket sides 63 and 64 have center folds 67 and 68 that extend from the top of the pocket sides to their bottoms. Similarly, the rear pocket sides 73 and 74 have center folds 77 and 78 that extend from the top of the pocket sides to their bottoms.

Suitable materials for both the container and the pockets may be paper stock, coated paper, plastic, foil or foil-covered paper. The material used must be flexible enough to allow the container and pockets to be collapsible. The pocket is appropriately sized to hold food products typically sold at a movie theater concession stand, such as a variety of candies. The volume of the pocket can range from 5 to 50 cubic inches, although a typical range is 25 to 35 cubic inches. The pocket openings 66 and 76 are sized so that a food product or other item can be easily placed into the pocket and be securely held while the user is carrying the container. The pocket opening can have an area ranging from 2 to 12 square inches, although a typical range is 4 to 8 square inches.

Figure 3:
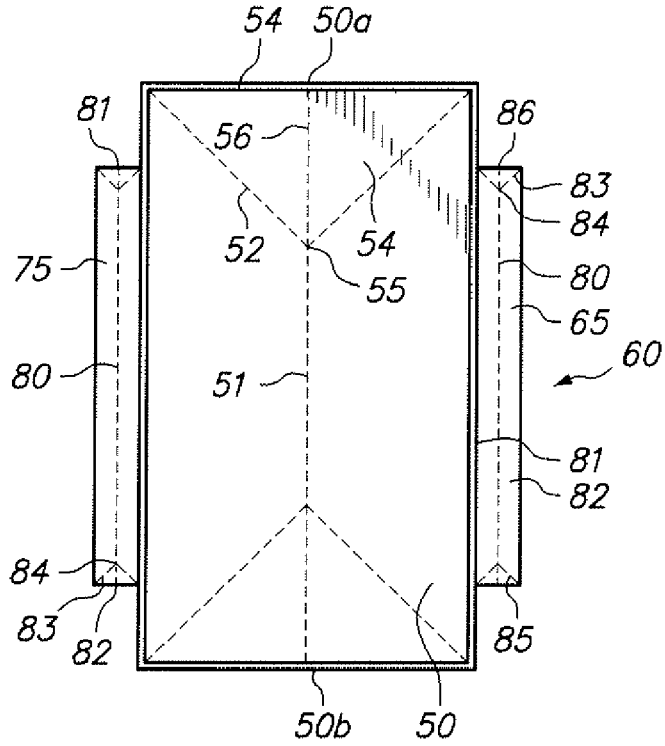
FIG. 3 is a bottom view of the container and both side pockets as illustrated in FIG. 2.

The bottom 50 of the container, shown in FIG. 3, has a center fold 51 which extends from the bottom of one side 50*a* to the bottom of the other side 50*b*. The bottom 50 also has four angular folds 52 which extend from each corner of the bottom to the bottom center fold 51 forming an apex 55. A triangular bottom section 54 is formed on opposite ends of the bottom between the angular folds 52 and the bottom of both sides 50*a* and 50*b*. The bottom center fold 51 has end sections 56 which extend between the apex 55 and the bottom of each side 50*a* and 50*b* and bisect each triangular section 54.

Similarly the bottom 65 and 75 of each pockets 60 and 70 respectively, have identical structure. Each has a center fold 80 which extends from the bottom of one pocket side 81 to the bottom of the other pocket side 82. The pocket bottoms also each have four angular folds 83 which extend from each corner of the pocket bottom to the pocket bottom center fold 80 forming an apex 84. A triangular bottom section 85 is formed on opposite ends of the pocket bottom between the angular folds 83 and the bottom of both sides 81 and 82. The bottom center fold 80 has end sections 86 which extend between the apex 84 and the bottom of each pocket side and bisect each triangular section 85.

Figure 4:
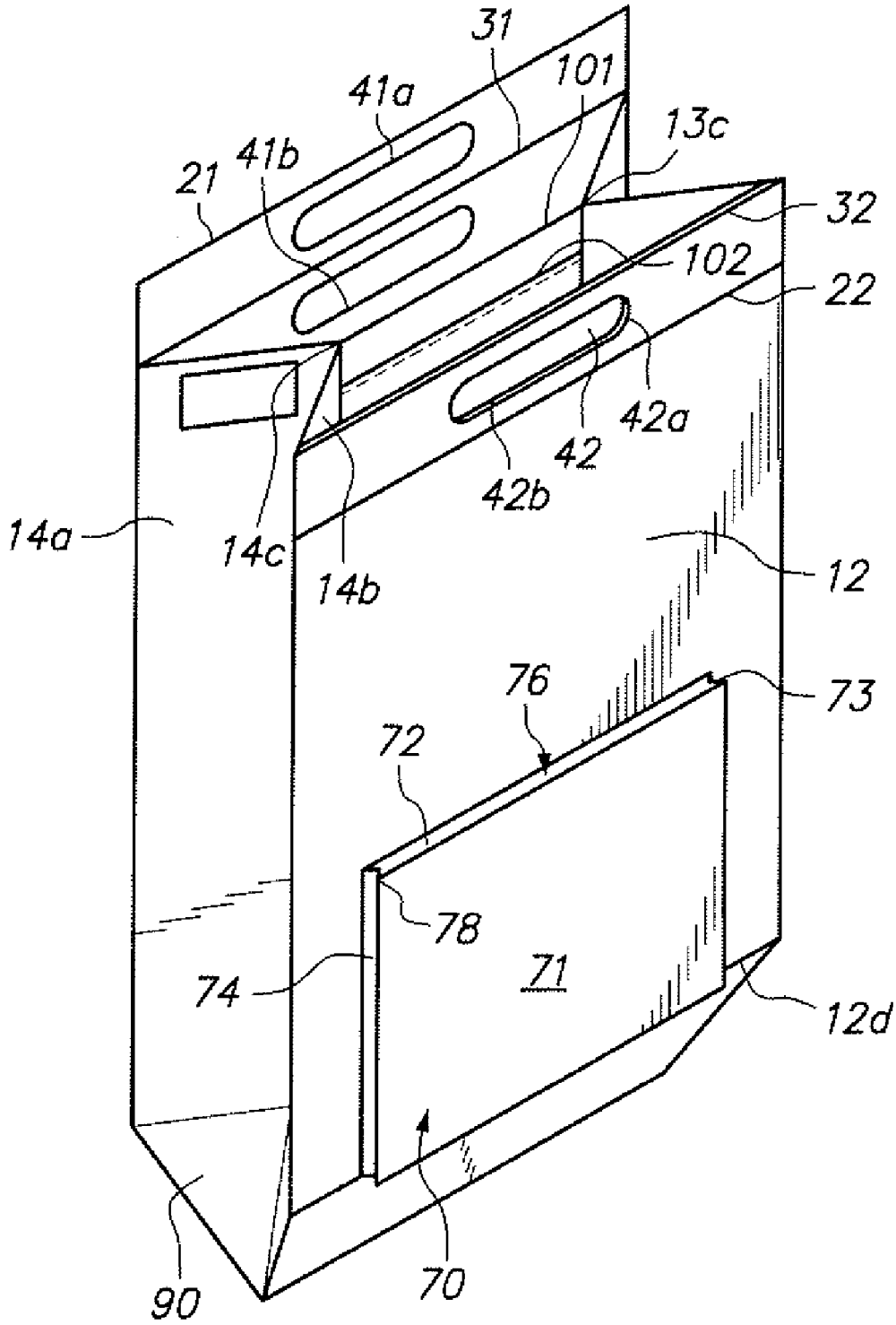
FIG. 4 is a side elevational view of the rear of the container and the rear side pocket. The front rear panel is shown before it has been folded down as illustrated in FIG. 1.

The container can be collapsed as shown in FIG. 4. The front and rear panels 11 and 12 are brought together by folding the sides at the center folds 13*c* and 14*c* which move inward towards the interior of the container. The bottom 50 is folded outwards along the bottom center fold 51, but the bottom center fold end sections 55 are folded inwards similar to the side center folds 13*c* and 14*c*. As the front and rear panels are brought together, the sides 13 and 14 and the triangular bottom sections 90 are folded in half along the side center folds 13*c* and 14*c* and the bottom center fold end sections 56 respectively.

The pockets can also be collapsed in an identical manner. The front and rear pocket panels 71 and 72 of pocket 70 are brought together by folding the pocket sides 73 and 74 at the center folds 77 and 78 which move inward towards the interior of the pocket. The pocket bottoms 65 and 75 are folded outwards along their bottom center folds 80, but the bottom center folds end sections 86 are folded inwards similar to the side center folds 77 and 78. As the front and rear panels are brought together, the sides 73 and 74 and the triangular bottom sections 85 are folded in half along the side center folds 77 and 78 and the bottom center fold end sections 86 respectively. Similarly, the same movement is performed on the analogous structures in pocket 60 to collapse it. The collapsed container and pocket can be pressed flat for compact storage.

In accordance with the provisions of the patent statutes, the principle and mode of operation of the present invention have been explained and illustrated in the preferred embodiment, however, it will be understood that the present invention may be practiced otherwise than as specifically explained and illustrated without departing from its spirit or scope.

Having described my invention, I claim:

1. A collapsible, elongate container for holding popcorn comprising:

a flat rectangular bottom;

a front panel having a top and a bottom, said front panel bottom joined to said flat bottom;

a rear panel spaced apart from said front panel having a top and a bottom, said rear panel bottom joined to said flat bottom;

inwardly folded, gusseted side panels which are both shorter and narrower than said front and rear panels, said side panels having a top and bottom, said side panels join to said flat bottom and connect the front panel and the rear panel such that the base of all panels are parallel;

a collapsible front pocket attached to the bottom of said front panel;

a collapsible rear pocket attached to the bottom of said rear panel;

said front and rear pockets including a flat pocket bottom joined to said container, a pocket front panel spaced apart from said container and extending upwards from said pocket bottom, and a pair of inwardly folded, gusseted side panels extending upwards from said pocket bottom and joining said front pocket panel and said container to form a pocket opening, said pocket being smaller in size than said container;

a lipped opening of the popcorn container, said lipped opening is formed by folding the top of the front panel and rear panel outwards and then down towards said flat bottom until they are even with the top of said side panels, said lipped opening has a centrally placed hole sized for fitting the fingers of a human hand, such that said lipped opening is able to be used as a handle allowing said container to be held; and sealing means allowing the front panel and rear panel portions of said lipped opening to be releasably sealed to one another in order to secure popcorn within said container, said sealing means further allowing a user to unseal said front and rear panels to gain access to the popcorn.

2. The invention disclosed in claim 1 wherein said front and rear pockets further includes a pocket rear panel attached to said container, said pocket front panel being spaced apart from said pocket rear panel, said pair of pocket side panels being joined to said pocket rear panel and to said pocket front panel to form said pocket opening.

3. The invention disclosed in claim 1 wherein said pockets are sized between 12 and 20 cubic inches to hold a concession item.

4. The invention disclosed in claim 1 wherein said sealing means is an adhesive disposed on opposite sides of the top of said gusseted side panels.

5. The invention disclosed in claim 1 wherein said sealing means is an adhesive disposed on opposite sides of the interior length of said lipped opening.

6. The invention disclosed in claim 1 wherein said sealing means is a mating male rib or bead and a female sealing channel closure along the length of the bag opening, said male and female portions create an airtight closure when they are properly aligned and pressed together along the length of the bag opening.

7. The invention disclosed in claim 1 wherein said sealing means is a pair of interlocking plastic backings located on the interior of the handles of said lipped opening.

8. The invention disclosed in claim 1 wherein said first and second side panels each having a fold and said bottom having a plurality of folds adapted for folding said container into a collapsed position wherein said top opening of said container is closed and for unfolding said container into a non-collapsed position wherein said top opening of said container is open.

9. The invention disclosed in claim 1 wherein a printed fill line is included on the interior side of said front panel, said fill line allows one to know how much popcorn to place in bag such that it can still be easily closed by said sealing means.

10. The invention disclosed in claim 1 wherein the dimensions of the container are approximately 12.5 inches high, 6.5 inches wide, and 4.25 inches deep, said height of container is 9.5 inches after the front and rear panels are folded down.

11. The invention disclosed in claim 1 wherein the dimensions of the container are approximately 13.5 inches high, 8.5 inches wide, and 4.5 inches deep, said height of container is 10.5 inches after the front and rear panels are folded down.

12. The invention disclosed in claim 1 wherein the dimensions of the container are approximately 14.5 inches high, 9 inches wide, and 4.75 inches deep, said height of container is 11.5 inches after the front and rear panels are folded down.

* * * * *